United States Patent [19]

Berkowitz

[11] Patent Number: 4,512,122

[45] Date of Patent: Apr. 23, 1985

[54] PANEL FASTENER SYSTEM

[75] Inventor: Irving L. Berkowitz, Binghamton, N.Y.

[73] Assignee: Kason Industries Inc., Binghamton, N.Y.

[21] Appl. No.: 373,907

[22] Filed: May 3, 1982

[51] Int. Cl.[3] ..... E04G 23/00

[52] U.S. Cl. ..... 52/127.9; 52/584; 29/453; 403/152; 403/157; 292/111; 292/DIG. 38; 292/DIG. 53

[58] Field of Search ..... 52/127.9, 127.7, 127.11, 52/584, 582; 29/453; 403/152, 158, 157; 24/217 R, 216; 292/DIG. 38, DIG. 53, 114, 111

[56] References Cited

U.S. PATENT DOCUMENTS

| | | | |
|---|---|---|---|
| 3,191,244 | 6/1965 | Burke | 52/584 |
| 3,341,233 | 9/1967 | Cushman | 52/584 |
| 3,392,497 | 7/1968 | Cushman | 52/584 |
| 3,400,958 | 9/1968 | Haimes | 52/127.9 |
| 3,565,469 | 12/1968 | Zwart | 52/584 |
| 3,661,410 | 5/1972 | Larson | 52/127.9 |
| 3,871,417 | 3/1975 | Filter | 403/157 |
| 4,020,613 | 5/1977 | Reynolds | 52/127.9 |

FOREIGN PATENT DOCUMENTS

| | | | |
|---|---|---|---|
| 1781476 | 9/1979 | Fed. Rep. of Germany | 292/DIG. 38 |

*Primary Examiner*—Henry E. Raduazo
*Attorney, Agent, or Firm*—Paul J. Sutton

[57] ABSTRACT

The present invention provides an improved panel fastener system for insulated slab panels of the type having one housing holding a hook assembly having a hook member and opposed hubs extending from a cam connected to the hook member; and a second housing having a pin adapted to receive the hook of the hook member. The invention provides an assembly method for mounting the hook member into the first housing including opposed resilient walls perpendicular to the front wall of the first housing forming a vertical slot adapted to receive the hook member. A pair of inclined planes lead from the rear portion of the housing to a pair of hub housing receptacles formed in the walls. The extended hubs are inserted into the slot from the rear of the housing along the inclined planes. The resilient walls are pressed back until the hubs reach the receptacles, at which time the biased walls snap back into their original configuration, capturing the hubs and the hook member in the first housing. The pin in the mating second housing is also snapped into position into the pockets of resilient clamps.

7 Claims, 8 Drawing Figures

PANEL FASTENER SYSTEM

This invention relates to an improved fastener system for molded wall panels having opposed housings mounted in the panels. More particularly, the invention relates to an improved fastener system wherein a hook mechanism is inserted in a one-piece male housing and a pin is inserted in a one-piece female housing in a rapid, efficient, and very inexpensive procedure. More particularly, the hook mechanism is assembled into the male housing by simply snapping it in along an inclined plane until it reaches a captive position.

Certain types of walls, such as refrigerator walls, are assembled from insulated slab panels factory molded from such insulating materials as polyurethane. Mounted within these panels are casings, or housings, containing fasteners for holding adjacent slabs in abutting positions as they are assembled. Usually the housings are mounted along the panel edges during the factory molding process. The housings contain opposed locking devices. In particular, as related to the present invention, these locking devices may include a hook assembly in one housing and a pin assembly in the opposed housing, the hook member being adapted to clip over the top of the pin upon rotation of the hook by means of a wrench. Further turning of the wrench will turn a cam attached to the hook member, thus pulling the hook member inwards. The adjacent panels are then pulled together and locked. This procedure is described in my U.S. Pat. No. 3,472,545 issued Oct. 14, 1969.

The manufacturing and assembly of the fastener system for the panels, that is, the housing with the hook assembly and the other housing holding the pin, can be somewhat laborious. Such systems are described in my U.S. Pat. No. 3,472,545 and in my U.S. Pat. No. 3,671,006, issued June 20, 1972, which describes refrigerator wall panels with panel fasteners and apparatus for making the panels. The fasteners are based upon metal construction including stamped metal sheets and related metal fastener parts which must be assembled with the sheets along with the hook assembly and pin. Mounting the hook assembly, a process described in my U.S. Pat. No. 3,472,545, is a somewhat laborious proceeding.

One of the main problems, therefore, associated with the prior art is that the panel fastener system is made up of a series of parts that must be manufactured and then assembled. Also, the material used, which must be strong to withstand the stresses created by the design, is metal throughout, which adds to the cost.

Accordingly, it is an object of the present invention to provide an improved panel fastener system having a first housing into which the hook assembly can be snapped into position during assembly.

It is a further object of this invention to provide an improved panel fastener assembly having a second housing onto which the pin can be snapped into position during assembly.

It is a further object of my invention to provide an improved panel fastener system having a housing into which the hook assembly can be snapped into place in a recess via an inclined plane.

It is yet a further object of my invention to provide an improved panel fastener system having the housing for the hook assembly forming a slot for receiving the hook assembly, the walls of the slot forming the inclined plane and the walls being movable from an unbiased position to a biased position by the hook assembly during insertion of the hook assembly into the housing.

It is yet a further object of my invention to provide an improved panel fastener system having one-piece male and female housings for holding the hook assembly and the pin that can be mated when the panels are being locked into position.

It is yet a further object of my invention to provide an improved panel fastener system that can be rapidly, efficiently, and very inexpensively assembled.

It is yet another object of my invention to provide an improved panel fastener system that provides one-piece molded plastic housings for holding the hook assembly and the pin.

It is a further object of this invention to provide an improved panel fastener system that provides a one-piece molded housing for the hook assembly having resilient, self-biased walls forming a hook assembly slot and forming an inclined plane leading to a recess, the hook assembly having a hub adapted to fit into the recess, the walls resiliently spreading during insertion of the hook assembly and snapping into position after passing a recess shoulder, thus capturing the hook assembly.

According to the present invention, the novel means and steps which are employed to overcome the disadvantages and problems sought to be overcome by this invention include two one-piece molded plastic housings, a male housing and a female housing, adapted to be mated together at the edges of the abutting panels being joined. In particular, the male housing is adapted to receive the hook mechanism which can be assembled into the male housing by simply snapping it into the housing along paired inclined planes until it is captively held in position. The hook mechanism includes a hook member attached to a cam which in turn is provided with two hubs having bearing surfaces, as is described, as mentioned, in my prior U.S. Pat. No. 3,472,545. The male housing has two opposed parallel walls forming a slot which is adapted to receive the hook member. The walls form, first, a bearing receptacle for rotatably mounting the bearing surfaces of the hubs; second, the walls form opposed inclined planes leading from the outer surfaces of the walls inwardly to inner surfaces of the walls, where they meet the bearing receptacles, having two opposed annular bearing surfaces having a shoulder formed with its respective inclined plane. The walls are resilient and in their normal state are unbiased. The outer opposed edges of the hubs press outwardly upon the walls as the hook mechanism is slid up the inclined planes during mounting and press the walls into a biased position. Once the hubs pass the shoulders and they become positioned in the annular receptacles, the walls are released of pressure and snap back into unbiased normal position, thus causing the hubs of the hook assembly to be held captive in the recess means. The female housing is also provided with resilient supports on either side of a second female slot that substantially mates with the male slot, the snap supports being adapted to receive a horizontal pin which may be snapped into the supports and held captive. This pin is the one described in my former patent discussed above.

My invention will be more clearly understood from the following description of a specific embodiment of the invention, together with the accompanying drawings, wherein similar reference characters denote similar elements throughout the several views, and in which.

Reference is now made in more detail to the drawings.

Figure 1:
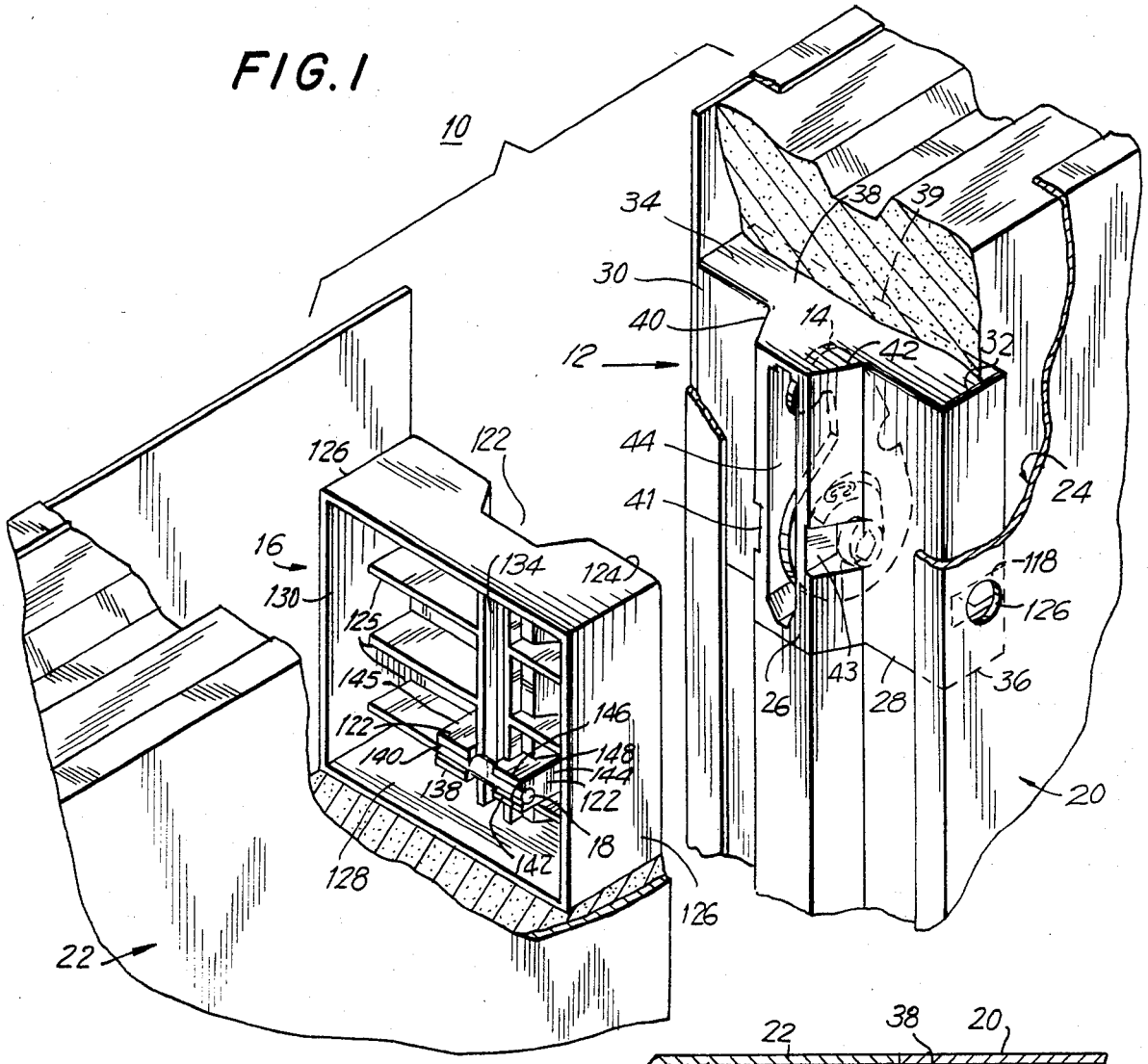
FIG. 1 is a perspective view according to the present invention illustrating the male and female housings with hook assembly and pin mounted in their respective housings, which are set in insulated slab panels, with the slab panels positioned prior to being joined.

FIG. 1 illustrates a perspective view of the fastener system 10 including male housing 12, mounting hook assembly 14 and female housing 16 mounting cross pin 18. The housings are set in adjoining insulated slab panels, positioned just prior to being joined together. Male housing 12 is mounted in first slab panel 20 and female housing 16 is mounted in second slab panel 22. The housings can be placed in the slab panel foam insulation after being molded by scooping out recesses and gluing in the housings, or by any other suitable method. Panel wall covers 24 are placed around the housings.

Male housing 12 is preferably of rigid, substantially rectangular design and construction as shown, except for vertical male member 26 positioned approximately at the center of vertical facing wall 28, which faces female housing 16. Male member 26 extends the vertical height of facing wall 28. Substantially parallel vertical side walls 30 and 32 and substantially perpendicular to horizontal top wall 34 and bottom wall 36, that are secured at their edge portions to facing wall 28. The facing, side, and end walls form a housing chamber 38 having a rear, open, side 39. Contained within the chamber are mounting walls 46 and 48 (FIG. 8), discussed below. Three shelves, (not shown) are for imbedding the housing 38 into the foam 99 of the panels. These shelves, are not seen in the view of the male housing for the sake of brevity but can be seen in the equivalent shelves 125 of female housing 16, described in detail below.

Male member 26 projects outward from front wall 28 of housing 12 and preferably has a wedge configuration in cross-section with upright slanted walls 40 and 42 being intercepted by a slot 50 formed by upright front walls 44, which is substantially perpendicular to facing wall 28. Walls 40 and 42 each form substantially the same angles with the front and facing walls. As illustrated, the angles between slanted walls 40 and 42 and front wall 28 are approximately 45 degrees, but of course this may vary. Identations 41 and 43 are formed in male member 26 to provide strength to a support structure within housing 12, as will be explained later.

Upright substantially parallel opposed mounting walls 46 and 48 (FIG. 8) are disposed in male housing 12 forming vertical slot 50 between them, which is also disposed approximately at the center of male member 26 and which runs the height of male housing 12 and vertical male member 265. Vertical, rear mounting walls 46 and 48 continue slot 50 in the rear of the housing along with wall portion 52 of top wall 34 and wall portion 54 of bottom wall 36. Slot 50 has opposed front open end 56 and rear open 58.

Figure 4:
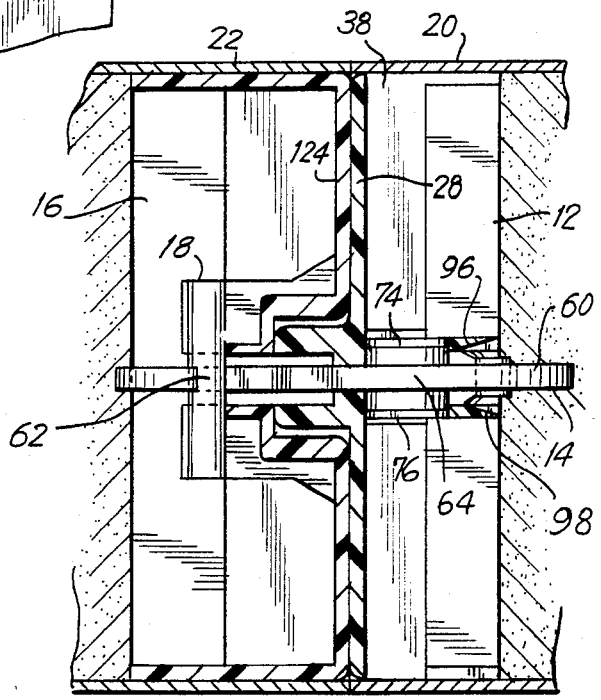
FIG. 4 is a top view of the present invention taken along line 4—4 in FIG. 3.
Figure 3:
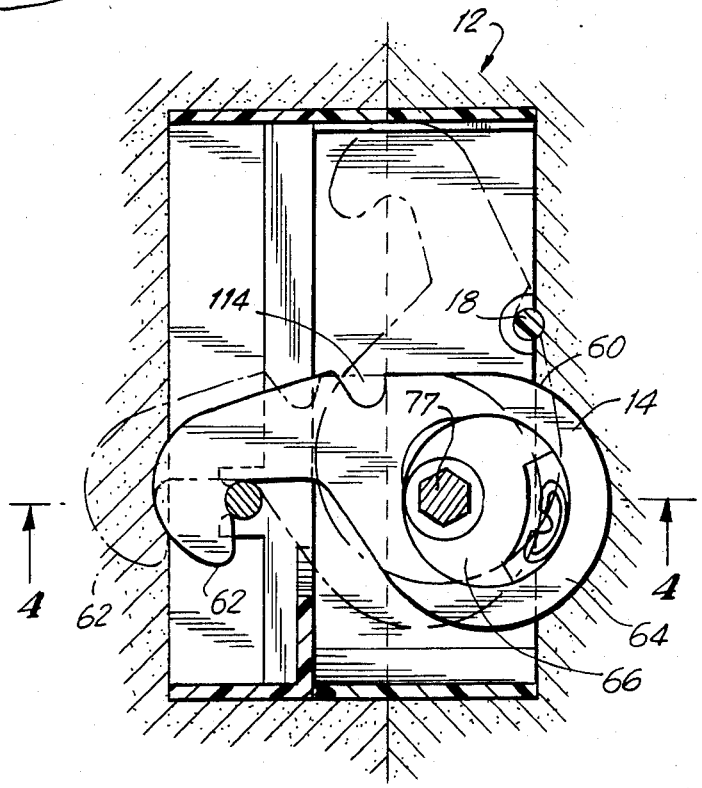
FIG. 3 is an elevated side view of the present invention showing the male housing taken along line 3—3 in FIG. 2.
Figure 5:
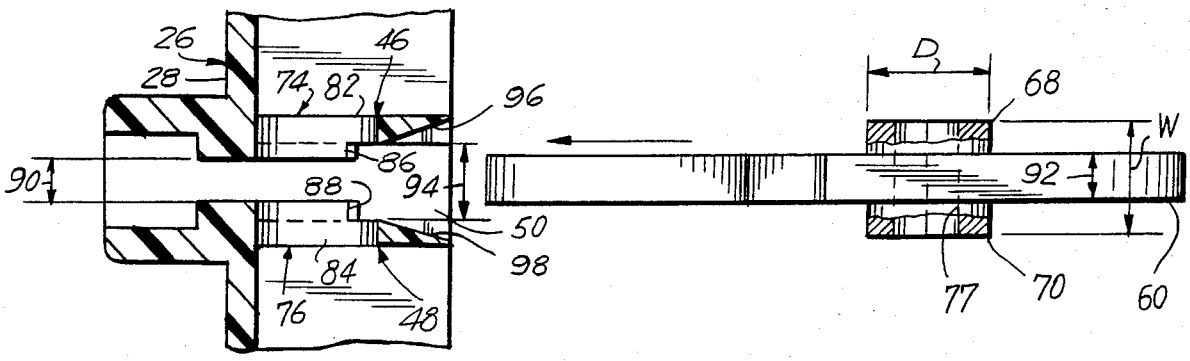
FIG. 5 is a schematic top cross-section view of the walls and slot of the male housing with the hook assembly moving into the slot for mounting in the hub bearing receptacles.
Figure 8:
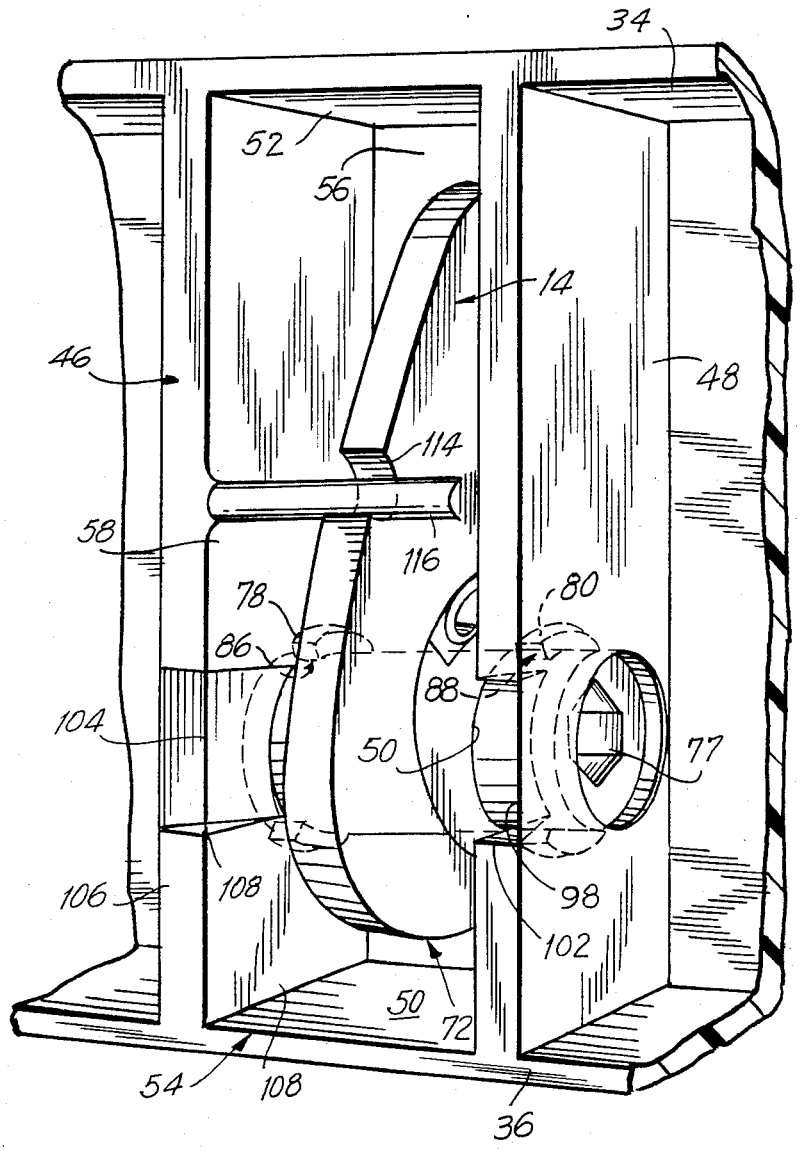
FIG. 8 is a partial perspective view of the walls of the slot including an inclined plane, hook assembly, and hub receptacles.

As illustrated in FIGS. 1 and 3, and in perspective in the view of FIG. 8, is a hook assembly 14 that is a substantially flat device positioned in slot 50 in a manner to be described. Hook assembly 14 includes a front hook 62 and a rear cam gripping portion 64 which is formed to slidingly engage cam 66 (FIG. 3). Opposed hubs 68 and 70 extend from either side of cam 66 and are preferably unitary with the cam. Gripping portion 64 is spring biased about cam 66 by leaf spring 109 for providing positive contact between said hook assembly 14 and the cam 66. This positive contact serves to keep the hook assembly from swinging freely such that it will remain in a position set by the user just prior to mating engagement with the pin assembly with which it cooperates. Hubs 68 and 70 have widths W, and a diameter D as shown in FIG. 5. In Hubs 68 and 70 and cam 66 is formed a horizontal aperture 77 adapted to receive the gripping surface of a wrench, preferably an allen wrench, as indicated by the hexagonal receiving surface shown in FIGS. 1, 3 and 8. Receptacles 74 and 76 each are formed in part by hub support members 78 and 80 extending from mounting walls 46 and 48, respectively. Receptacles 74 and 76 can be seen in FIG. 4 and also in schematic cross-section in FIGS. 4, 5, and 6, which will be discussed later in further detail with reference to the mounting of hook member 14 to male housing 12. Receptacles 74 and 76 are also formed in part by hub receiving apertures 82 and 84 formed by mounting walls 46 and 48, respectively. Receptacles 74 and 76 also extend outwardly from walls 46 and 48 by second hub support members 78 and 80, which are adjacent to support indentations 41 and 43. Hub support members 78 and 80 each form substantially horizontal hub passages 86 and 88, respectively. They face toward the rear, or open, side 39 of male housing 12, and have substantially the same width of hubs 68 and 70. They are designed and constructed to receive and pass hubs 68 and 70, which application will be described in detail below. Hub support members 78 and 80 each extend inwards toward slot 90 and towards one another. Slot 90 lies between the receptacles 74 and 76, and is substantially equal to the width of flat hook assembly 14, which is consistent in width throughout, except for extending hubs 68 and 70. Slot 90 is adapted to receive the width of hook member 14 in close fit. Well 50 is likewise adapted to receive the width of hook assembly 14, but in ample fit. That is, slot 50 has a width $\overline{W}$, which is equal to the width W of hook assembly 14, but a distance less than the hub widths W (FIG. 5).

Mounting walls 46 and 48 also form ramps, or inclined planes, 96 and 98 respectively, which are for spreading resilient mounting walls 46 and 48 apart as hubs 68 and 70 are being slid along planes 96 and 98 on their way to receptacles 74 and 76, respectively during assembly of hook assembly 14 to male housing 12 (See FIG. 8). Inclined planes 96 and 98 are coextensive with grooves 100 and 102 respectively, which are formed in the mounting walls 46 and 48 as planes 96 and 98 excavate side channels in the mounting walls. Grooves 100 and 102 have substantially the same width as the diameters. Grooves 100 and 102 serve to guide hubs 68 and 70 within the side walls of the grooves along inclined planes 96 and 98. Inclined planes 96 and 98 are adapted to receive and slidingly pass hubs 68 and 70 to hub passages 86 and 88 of hub support members 78 and 80 along grooves 100 and 102, which have substantially the same widths as diameters of hubs 68 and 70.

Inclined planes 96 and 98 extend from the outer walls inwardly toward the inner walls defining hub passages 86 and 88 of hub support members 78 and 80. This design and construction is typified by inclined plane 96 having receiving edge 104 at outer surface 106 of wall 46 and angled inwards into well 50 until it meets inner surface 108 of plane 96. The width of the plane is substantially the same as the diameter D of hub 70, thus forming horizontally angled walls of hub groove 100, with mounting wall 46. Groove 100 along with groove 102 are adapted to guide hubs 70 and 68, respectively, to hub recess means including annular bearing receptacles 74 and 76 through hub receiving apertures 86 and 88. Receptacles 74 and 76 have cylindrical bearing surfaces so that the hubs can rotate within the receptacles.

Figure 6:
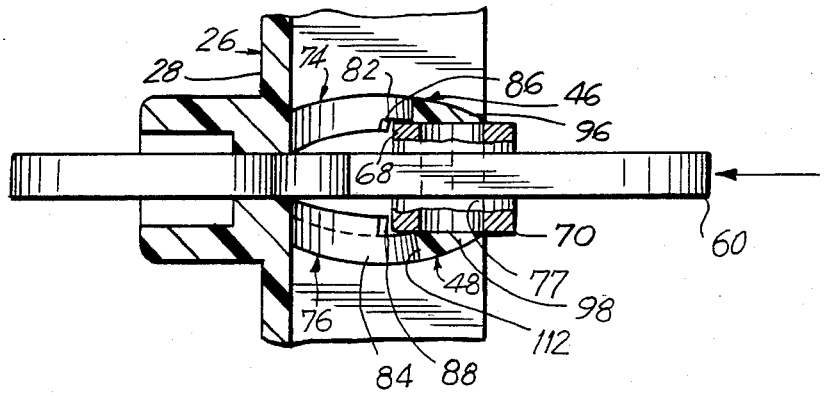
FIG. 6 is a schematic top cross-section view similar to the view shown in FIG. 5 with the hook assembly in the process of pressing apart the slot wall en route to hub receptacles.
Figure 7:
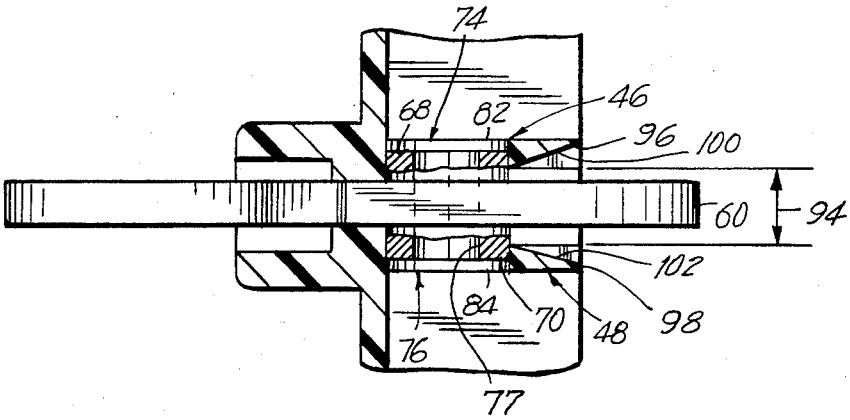
FIG. 7 is a schematic top cross-section similar to the views in FIGS. 6 and 7 showing the hook assembly in position with the hubs in position in the hub receptacle.

As shown in FIGS. 5, 6, and 7, hook assembly 14 is mounted to male housing 12 by placing the outer edges of hubs 68 and 70 at the inclined planes 96 and 98 and pressing them along the planes to receptacles 74 and 76. During this movement, mounting walls 46 and 48, which are movable between a normal position to a outwardly biased position (FIG. 6) from slot 50, are spread apart by the force of the hub ends against the planes 96 and 98. When shoulders 112 and 114 are passed and the hubs enter into receptacles 74 and 76, walls 46 and 48 are no longer pressed apart and by force of their own resilient self-bias, and snap back into their normal positions, causing the hubs to be captured in the receptacles (FIG. 7). Hook assembly 14 is now locked in walls 46 and 48 for rotatable movement in male member 12 at bearing receptacles 74 and 76.

Figure 2:
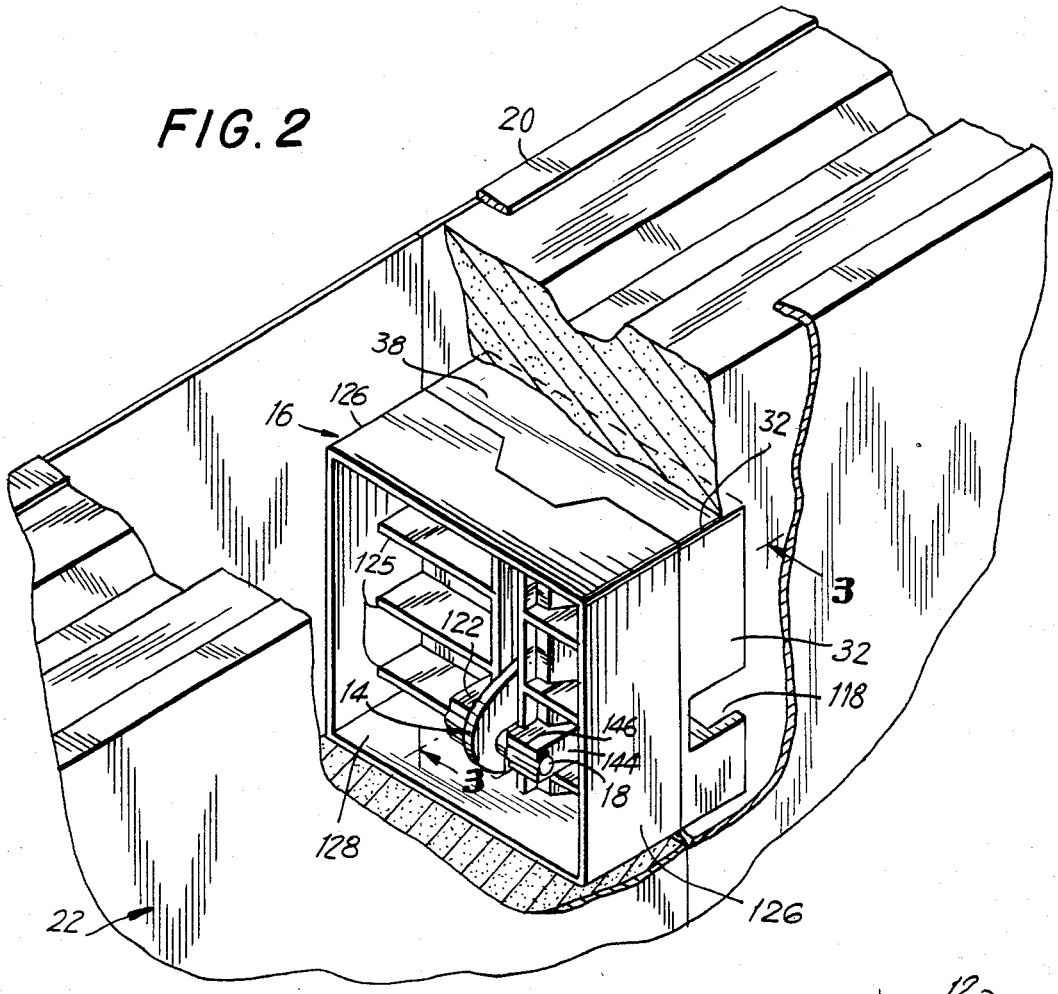
FIG. 2 is a perspective view of the present invention showing the male and female housings in mating position and the slab panels drawn into locked position with the hook member of the hook assembly in locking relationship with the pin.

Hook assembly 14 can then be swung vertically upwards until hook 62 is spaced adjacent to top wall 34. Hook assembly 14 has a notch 114 that, when the hook assembly has been drawn back into substantial vertical position in slot 50, engages with cross-bar 116 (as shown in FIG. 3), which, like the rest of male housing 12, is cast of a resilient preferably plastic material. Notch 114 snaps onto cross-bar 116 when a wrench is inserted into hub aperture 77 via wrench apertures formed on both side walls 30 and 32, typified by wrench apertures 118 in side wall 32 (FIG. 2). Aperture 118 is coextensive with wrench hole 126 formed in panel cover 24 (FIG. 1). Thus, upon rotation of the hook assembly 14 by a wrench inserted through the noted wrench aperture, and the wrench being turned, notch 114 is snapped onto resilient cross-bar 116, which stations the hook assembly until it is ready to be joined to female housing 16.

Female housing 16 is fashioned in an analogous manner to male housing 12, with the exception of a vertical female receiving portion, or cavity, 112, which is capable of receiving male member 26 of male housing 12 (FIG. 1). Like male housing 12, female housing 16 is made of a one-piece molded plastic material, which is resilient. Facing wall 124 of which cavity 122 is a part thereof, opposes male facing wall 28. Opposed side walls 127, bottom wall 128 and top wall 129 define the female housing, which has open side 130 opposing facing wall 124. Three horizontal shelves 125 are positioned on the inner surface of facing wall 124 for foam gripping purposes when female housing 16 is mounted into panel 22, which is to be joined to panel 20. Projections 122 extend from facing wall 124 and are capable of being received in mating relationship with support indentations 41 and 43 of male housing member 12. Female housing oblong vertical slot, or passage, 134 is of the same width as slot 50 in male housing 12 and is substantially coextensive with slot 50. A cross-pin 18 is mounted across slot 134 and is positioned to receive hook 62 when it is dropped from male member 12 into female slot 134. Cross-pin 18, which is made of a strong material, preferably metal, is mounted onto a pair of clamps, or snap mounting means, 138. Mounting means 138 includes horizontal pockets 140 and 142 formed by resilient upper and lower gripping portions 114 and 145 which project from the inner side of housing 16 adjacent to facing wall 124. Gripping portions 144 and 145 are made of the same resilient, self-biased material as housing 16. After molding is completed, pin 18 is press-fitted into gripping portions 144 and 145. When the pin 18 is pressed into the resilient pockets 140 and 142, the gripping portions 144 and 145 snap back to their normal unbiased position by force of their self-biased action.

Once the male and female housings 12 and 16 are fitted with hook assembly 14 and pin 18, and the housings have been mounted to the sides of slab panels 22 and 24, the two slab panels are lined up for joining. The two slab panels are pressed together until housings 12 and 16 come together and their facing walls 28 and 124 come into contact. Then the user inserts a wrench into wrench aperture 77, and turns the wrench, thus rotating the hook assembly towards the female housing 16. Hook assembly 14 pulls loose from cross-bar 116 to cross over into engagement with female cross-pin 18. Further turning of the wrench causes cam 66 to rotate within hook assembly 14 and to tighten and pull hook 62 horizontally into a tight locking relationship with cross-pin 18. Thus, male housing 12 and female housing 16 are tightly drawn together in mating relationship and panels 20 and 22 are likewise tightly locked together. The number of fastener systems per panel is, of course, dependent upon factors such as panel size.

Both male housing 12 and female housing 16 are made of resilient material and each is preferably formed as a one-piece molded housing, including the infra structure.

The embodiment of the invention is described here merely as an example of the invention. Other embodiments, forms, and modifications of the invention coming from the proper scope of the appended claims, will, of course, readily suggest themselves to those skilled in the art.

What is claimed is:

1. An improved fastener system for insulated slab panels, the fastener being of the type having the first housing mounting a hook assembly and a second housing mounting a pin, the first and second housings being locked together via the hook assembly and pin, the hook assembly including a cam, a hook extending from the cam, and opposed extended hubs mounted transversely from the cam, said system in combination, comprising;

walls disposed in said first housing forming a slot therein for receiving said hook member and for positioning said hook member for attachment to said pin of said second housing, means defining a recess disposed in each of said walls, said recess for receiving said hubs of said hook assembly for pivotable mounting, an inclined plane disposed in each of said walls for spreading out said wall means into a biased position when said hubs are moved along said walls towards said recess means, said walls being movable from said biased position to an unbiased position after said hubs have moved along said inclined planes to said recess means, whereby said hubs are positively captured in said recess means, and said hook assembly is resiliently locked within said first housing for rotatable movement therein, and biasing means disposed between said hook and said cam for providing positive contact therebetween, said first housing having an upright front wall facing said second housing, said wall including a pair of upright opposing walls spaced one from another to form said slot, said slot being disposed substantially vertically in said front wall, said recesses including a pair of annular bearing receptacles adapted to receive said hubs, said receptacles being disposed on opposite sides of said slot closely spaced to an inner surface of said front wall, said annular bearing receptacles including opposed hub receiving apertures formed in said opposing walls, and wherein said annular bearing receptacles further including a pair of opposed support members extending from the inner surfaces of said opposing walls, said support members forming hub receiving apertures coextensive with said annular bearing receptacles, said support members forming hub passages adapted to receive said hubs as said hubs are moved along said inclined.

2. A system for mounting a hook assembly according to claim 1, wherein said inclined planes include opposed inclined planes formed on the inner surfaces of said pair of opposing walls, said inclined planes each extending from an outer surface of respective opposed walls inwardly to the inner surfaces of said opposed walls at said hub passages to said pair of annular bearing receptacles.

3. A system for mounting a hook assembly according to claim 2, wherein said opposed walls and said first housing are unitary and made of a resilient material.

4. A system for mounting a hook assembly according to claim 1, wherein said second housing has an upright forward wall facing said front wall of said first housing, said front wall having disposed therein an upright oblong passage substantially coextensive with said slot of said first housing for receiving said hook from said first housing.

5. A system for mounting a hook assembly according to claim 4, further including a pair of horizontally disposed clamps having pockets mounted within said housing on either side of said passage and a cross-pin held by said clamps in said pockets for receiving said engaging said hook of said hook assembly, said clamps being resiliently biased and movable between an unbiased position and a biased position, said clamps being adapted to spread apart to a biased position when said cross-pin is pressed into said pockets, and to snap back into an unbiased position after said said cross-pin has been set in said pockets.

6. A system for mounting a hook assembly according to claim 5, wherein said first housing has a vertical projecting male member and said second housing forms a vertical female cavity, said male and female members having complementary configurations, said slot being centrally disposed in said male member and said oblong passage means being centrally disposed in said female cavity, said slot means and said oblong passage being substantially coextensive.

7. A system for mounting a hook assembly according to claim 2, further including a notch formed on the top portion of said hook, and a cross-bar connected to rear edges of said pair of opposing walls and disposed across said slot above said recesses, said cross-bar being resiliently movable between unbiased and biased position, said cross-bar being adapted to receive said notch in resilient releasable engagement.

* * * * *